United States Patent [19]

Pundak

[11] Patent Number: 4,769,997

[45] Date of Patent: Sep. 13, 1988

[54] MINIATURIZED STIRLING TYPE COOLER

[76] Inventor: Nachman Pundak, Kibbutz Ein Harod, Israel

[21] Appl. No.: 871,709

[22] Filed: Jun. 6, 1986

[51] Int. Cl.[4] ..... F25B 9/00
[52] U.S. Cl. ..... 62/6; 60/520
[58] Field of Search ..... 60/520; 62/6

[56] References Cited

U.S. PATENT DOCUMENTS 4,545,209 10/1985 Young ..... 62/6
4,558,570 12/1985 Shtrikman et al. ..... 62/6

OTHER PUBLICATIONS

Philips, "Single-Cyclinder Gas Cooling Machine with Circulating Head", Type PGA-105, Nov. 14, 1960.
Norelco, "Cryogenerators", Jan. 14, 1962.

*Primary Examiner*—Henry A. Bennet
*Attorney, Agent, or Firm*—Toren, McGeady & Associates

[57] ABSTRACT

A Stirling cryogenic cooler system comprises a sealed casing, the drive for the cooler being constituted by a brushless DC motor where the stator and the driving electronics are positioned outside the casing, the rotor is transmitting rotational movement to the piston and displacer of the cooler via a crankshaft.

1 Claim, 1 Drawing Sheet

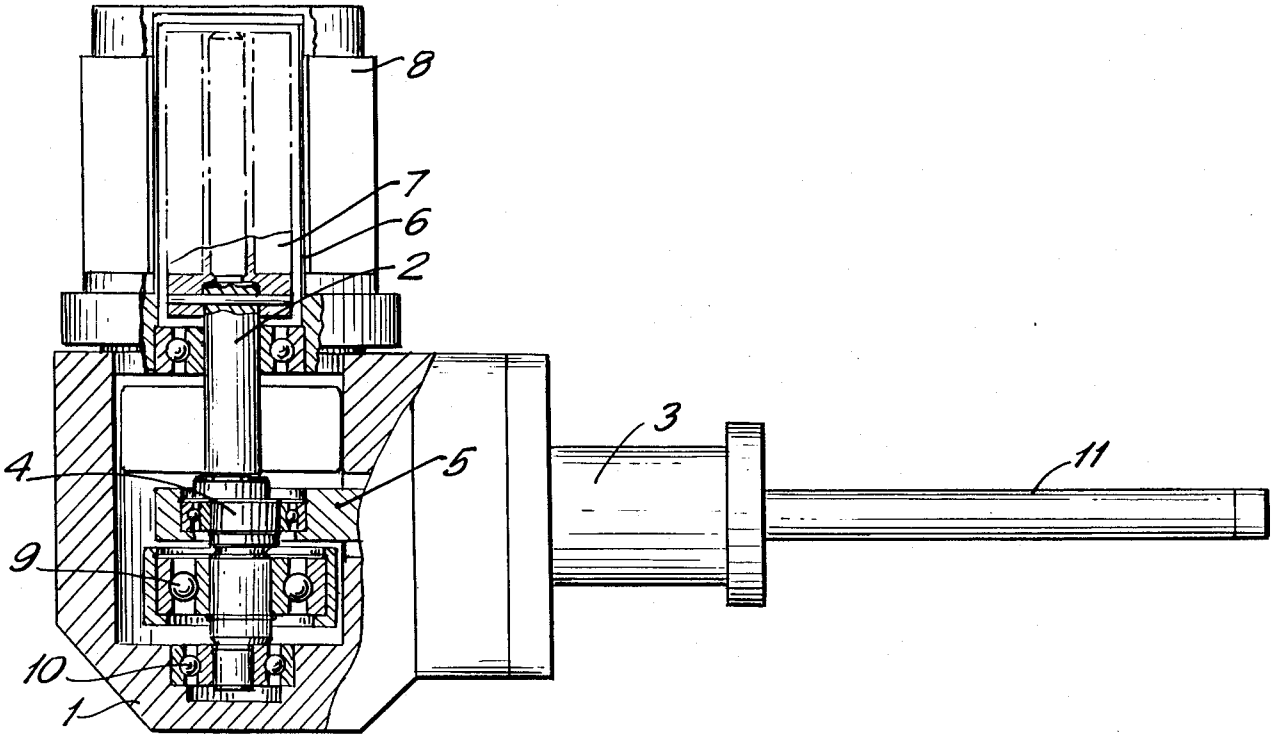
8
7
6
2
11
3
5
4
9
10
1

MINIATURIZED STIRLING TYPE COOLER

FIELD OF INVENTION AND ITS BACKGROUND

This invention concerns closed cycle cooling systems and more particularly those of miniature Stirling type. As is known, such systems include as basic parts thereof two major components: the compressor unit and the expansion unit. One group of such coolers is of the so called "split type" wherein compressor and expander unit are strictly separate from one another and are interconnected by a gas conduit or conduits. The second group is of the so called "integral type" wherein compressor and expander are mechanically coupled and activated by the same crankshaft.

In a cooler belonging to the Stirling thermodynamic cycle kind, there is provided a sealed casing containing the compressor unit only in the split type and the compressor and expander in the Integral type cooler. The cooler includes a crankshaft driven by an electromotor. A piston actuated by the said shaft creates the required pressure pulses and the columetric reciprocal change in the expander in the integral type cooler.

In the Stirling type of cooler, the electromotor is conventionally located within the gaseous atmosphere, i.e., the gas used in operating the cooler. Obviously, specially designed motors have to be employed.

Now, as is known, one of the reasons for faulty performance of the cooler is contamination of the gas caused to a large extent by residual gas remaining in the system after precluding or due to evaporation of high vapour pressure materials in the interior of the cooler. So, e.g. organic varnishes used for insulating rotor or stator windings of the motor are a main source of gas contamination. The motor, being located within the working gaseous atmosphere, presents certain problems of maintenance, since in order to reach it, the region where the gas is contained in has to be open to the air.

In order to do away with the above disadvantageous, I have suggested in my U.S. Pat. No. 4,558,570 to use an ordinary - not specially designed - electromotor and to locate it at the exterior of the gas enclosing housing and to provide a magnetic torque-coupler for the rotational transfer of drive from the electromotor to the compressor crankshaft located within a casing in relation to which the motor is exteriorily located.

OBJECT OF THE INVENTION

Now in order to minimise the size of the cooler and to lower its weight there is suggested a novel construction using a D.C. brushless motor and to locate its stator and driving electronics at the exterior of the enclosing housing and to couple the rotor directly to the crank-shaft. The motor stator and the rotor are separated by a non-magnetic metal partition which is a part of the sealed cooler casing, thus eliminating the necessity of use of a magnetic torque-coupler.

SHORT SUMMARY OF DISCLOSURE

According to the invention—therefore—there is provided a cryogenic cooler system of the Stirling type which is sealed into a casing, the drive for the said cooler unit being constituted by a brushless D.C. motor whereof the stator and the driving electronics are positioned outside the said housing, the motor rotor being located inside the sealed cooler casing and being directly coupled to the crankshaft which supplies linear movement to the piston of the compressor and the displacer in the expander of the system.

SHORT DESCRIPTION OF DRAWING

The invention will now be described in detail with reference to the accompanying single FIGURE of schematic drawing which incidentally shows the Integral Stirling construction. It is remarked that the invention is not restricted to this type.

DETAILED DESCRIPTION OF PREFERRED EMBODIMENT

In the drawing, the numeral 1 designates the sealed housing (crankcase) of the cooler. The crankshaft is designated by reference numeral 2. 3 is the expander head and 4 is the crankshaft cam driving the expander connecting rod 5. A non-magnetic cup shaped cover 6 is clamped to the crankcase 1 and contains the motor rotor 7 which is directly coupled to the crankshaft 2. The brushless type motor stator and position sensor assembly 8 is in a coaxial location over the cover 6 and the motor rotor 7. The numerals 9 and 10 designate conventional ball bearings for the crankshaft. The cold finger is indicated by numeral 11.

It will be seen that the novel arrangement keeps the stator assembly out of the working gas atmosphere and prevents contamination of the gas, thus ensuring a longer lifetime of the cooler.

Moreover, this arrangement is less expensive and smaller in size than any other known such cooler and more reliable due to elimination of parts such as the magnetic torque-coupler.

It is of advantage that no electrical feedthroughs are required into the sealed crankcase, reducing the leakage risk. This arrangement allows motor and driving electronics maintenance in the conventional way and can be exchanged if necessary without entering the gas compartment.

I claim:

1. In a cryogenic Stirling type cooler system, an axially extending casing, a compressor unit located within said casing and including a crankshaft extending transversely of said casing axis, an expander and expander connecting rod arranged co-axially in and with said casing said casing including a cover having an axis in coaxial relation with said crankshaft, said casing and cover forming a sealed housing for said compressor unit and crankshaft, said cover comprising a cup-shaped non-magnetic partition, a drive for said compressor unit comprising a D.C. brushless motor including a stator, a rotor and driving electronics, said rotor located within said cover in said sealed housing and coupled directly to said crankshaft, said crankshaft connected to said expander and compressor connecting rods, said stator located outwardly of an encircling said cover in coaxial relation with said rotor, said drive electronics located outwardly of said casing, whereby said rotor is located within said sealed housing in driving engagement with said crankshaft while said stator is located outside said sealed housing for driving said rotor so that said rotor supplies rotational movement to said crankshaft which is converted by said crankshaft cam for driving said expander and compressor connecting rod.

* * * * *